US008956041B2

(12) United States Patent
Forsey et al.

(10) Patent No.: US 8,956,041 B2
(45) Date of Patent: Feb. 17, 2015

(54) TIMEPIECE WITH TOURBILLON MECHANISM HAVING A SUPPORT

(75) Inventors: Stephen Forsey, Les Brenets (CH); Dylan Roth, Neuchatel (CH)

(73) Assignee: GFPI S.A., La Chaux-de-Fonds (CH)

( * ) Notice: Subject to any disclaimer, the term of this patent is extended or adjusted under 35 U.S.C. 154(b) by 0 days.

(21) Appl. No.: 14/123,988

(22) PCT Filed: Jul. 5, 2012

(86) PCT No.: PCT/EP2012/063139

§ 371 (c)(1),
(2), (4) Date: Dec. 5, 2013

(87) PCT Pub. No.: WO2013/004782

PCT Pub. Date: Jan. 10, 2013

(65) Prior Publication Data

US 2014/0126338 A1 May 8, 2014

(30) Foreign Application Priority Data

Jul. 7, 2011 (CH) ..... 1145/11

(51) Int. Cl.
*G04B 15/00* (2006.01)
*G04B 17/28* (2006.01)

(52) U.S. Cl.
CPC ..... *G04B 17/285* (2013.01)
USPC ..... 368/127; 368/170

(58) Field of Classification Search
USPC ..... 368/124–127, 168–170
See application file for complete search history.

(56) References Cited

U.S. PATENT DOCUMENTS 7,004,619 B2 * 2/2006 Papi ..... 368/127
7,160,026 B2 1/2007 Golay (Continued)

FOREIGN PATENT DOCUMENTS

| | | |
|---|---|---|
| CH | 7965 | 3/1967 |
| CH | 698 315 | 7/2009 |
| EP | 1 574 916 | 9/2005 |

(Continued)

OTHER PUBLICATIONS

International Search Report dated Oct. 16, 2012, corresponding to PCT/EP2012/063139.

*Primary Examiner* — Sean Kayes
(74) *Attorney, Agent, or Firm* — Young & Thompson

(57) ABSTRACT

A timepiece includes: a frame; a mobile body of a finishing gear train; and a tourbillon mechanism including a holder supporting a balance and at least one escapement. The tourbillon mechanism includes: an outer ring rotatably mounted onto the frame about a first axis; at least one inner ring inside the outer ring and rotatable relative to the outer ring about a second axis, the holder being pivotably mounted in the inner ring and secured to a shaft around which the inner ring is freely and rotatably mounted about a third axis; a first toothed member mounted onto the frame; a first pinion secured to the shaft of the holder to engage with the first toothed member to rotate the holder; and a unit driving the inner ring, engaging with the movable body of the finishing gear train and arranged to move the inner ring and, consequently, the outer ring.

8 Claims, 7 Drawing Sheets

(56) References Cited

U.S. PATENT DOCUMENTS

| | | | | |
|---|---|---|---|---|
| 7,445,375 | B2 * | 11/2008 | Kasapi | 368/127 |
| 7,677,793 | B2 * | 3/2010 | Lete et al. | 368/127 |
| 7,744,271 | B2 * | 6/2010 | Jansen et al. | 368/127 |
| 7,815,364 | B2 * | 10/2010 | Kasapi et al. | 368/127 |
| 7,857,501 | B2 * | 12/2010 | Salathe | 368/127 |
| 8,210,739 | B2 | 7/2012 | Greubel et al. | |

FOREIGN PATENT DOCUMENTS

| | | |
|---|---|---|
| EP | 1419419 | 11/2005 |
| EP | 2 031 465 | 3/2009 |
| EP | 2132604 | 6/2011 |
| WO | 03/017009 | 2/2003 |
| WO | 2004/077171 | 9/2004 |
| WO | 2005/071498 | 8/2005 |

* cited by examiner

TIMEPIECE WITH TOURBILLON MECHANISM HAVING A SUPPORT

TECHNICAL FIELD

The present invention relates to mechanical timepieces. It more particularly relates to a timepiece comprising a frame, at least one wheel of a going train and at least one tourbillon mechanism comprising a support, such as a carriage, supporting a balance and at least one element of an escapement.

BACKGROUND OF THE INVENTION

A tourbillon mechanism is a device intended to average the running deviation of the positions of the balance of a timepiece. In the present invention, such a tourbillon comprises the traditional tourbillon comprising a tourbillon carriage as well as the carousel. To that end, a tourbillon includes a support (for example, a carriage in the case of the traditional tourbillon) pivotably mounted on the frame, in general an assembly formed by a bar and a plate and, pivotably mounted on the support, a sprung balance and an escapement in particular including an escapement wheel provided with a disc and a pinion. The support includes a gear kinematically connected to the going train of the timepiece, in general to the mean disc. A toothed wheel, mounted fixed on the frame, meshes with the escapement pinion. In this way, each time the balance is in position to receive a driving impulse from the escapement, the torque applied by the mean disc on the gear causes the support to rotate slightly, the impulse from the balance being given by the escapement whereof the wheel turns by meshing of its pinion with the toothed disc. The discs and pinions are generally arranged and numbered such that the tourbillon performs one revolution per minute. Thus, when the timepiece is positioned vertically, the position of the dead point of the balance therefore performs one revolution per minute, which averages the running deviations in the vertical positions. However, the lag between the horizontal and vertical positions remains.

Different solutions have been proposed to offset this drawback.

Known for example is a tri-axial tourbillon described in application EP 1,574,916, comprising a carriage containing the balance and the escapement rotating along an axis, the carriage being mounted in a second carriage so as to be able to rotate around the axis, the second carriage being rotatably mounted in turn in a third carriage rotating around a stationary axis relative to the timepiece, the three axes being perpendicular to one another. The tri-axial tourbillon is driven by a driving disc mounted on the plate of the timepiece, which drives a pinion secured to the third carriage, and causes the carriage to rotate around its axis, thereby setting a pinion in rotation meshing with a crown fixed on the plate of the timepiece, which rotates the carriage around its axis, the second carriage setting the first carriage in rotation around its axis by means of a crown and the fourth-wheel pinion secured to the third carriage, and thus to transmit the energy coming from the drive disc to the assembly formed by the escapement pinion, the escapement disc and the balance placed in the first carriage.

Such a mechanism has the drawback of being bulky and not very aesthetically pleasing due to the presence of several toothed crowns appearing on the dial side.

Also known is a differential correction device described in application EP 2,031,465. This device comprises several supports pivotably mounted around respective articulation axes, which makes it possible to neutralize the movements of a transmission train around two or more axes. The aim of this mechanism is to keep the seat of the support bearing the adjusting system in a constant position irrespective of the position of the frame. The isochronism faults of the system are eliminated, given that the oscillating system has only one position. Such a mechanism does not have the same aims as a tourbillon mechanism, which makes it possible to further reduce the running differences between horizontal and vertical positions of a timepiece comprising such a tourbillon mechanism.

One aim of the present invention is therefore to offset these drawbacks, by proposing a timepiece comprising a tourbillon mechanism making it possible to further reduce the running differences between horizontal and vertical positions.

Another aim of the present invention is to propose a timepiece comprising a tourbillon having a reduced bulk and improved aesthetic appearance.

BRIEF DESCRIPTION OF THE INVENTION

To that end, and in accordance with the present invention, proposed is a timepiece comprising a frame, at least one wheel of a going train, and at least one tourbillon mechanism comprising a support bearing a balance and at least one element of an escapement.

According to the invention, the tourbillon mechanism further comprises:

- an outer ring rotatably mounted on the frame around a first axis,
- at least one inner ring mounted inside the outer ring and rotatable relative to the outer ring around a second axis, preferably perpendicular to the first axis, the support being pivotably mounted in the inner ring and said support being secured to an arbor around which the inner ring is mounted freely rotating along a third axis,
- a first toothed organ, mounted on the frame,
- a first pinion secured to the arbor of the support arranged to cooperate with said first toothed organ so as to rotate said support, and
- means for driving the inner ring cooperating with a wheel of the going train and arranged to move the inner ring and the outer ring accordingly, giving the support a composite movement.

This composite movement of the support makes it possible to further reduce the running differences between the horizontal and vertical positions, as described in patent EP 1,419,419.

Advantageously, the means for driving the inner ring may comprise a driving element secured to an arbor of the disc of the going train.

The first toothed organ may be securely fixed to the frame. This then creates a tourbillon mechanism. When the first toothed organ is not securely fixed to the frame, it is then a carousel mechanism as described in patent CH 7965.

According to a first alternative, the driving element cooperates with the arbor of the support so as to impose a rotating movement thereon around the first toothed organ.

According to a second alternative, the inner ring comprises a tube that is secured thereto, wherein the arbor of the support can rotate freely, the driving element cooperating with said tube so as to impose a rotational movement around the first toothed organ on the inner ring.

Preferably, the arbor of the support forms a non-zero angle with the first toothed organ. However, in other alternative embodiments, said angle may be a non-zero angle.

Advantageously, the tourbillon mechanism may further comprise a second toothed organ secured to the inner ring and arranged to cooperate with a second pinion kinematically connected to the escapement.

According to different possible embodiments, the support may be positioned such that its axis of rotation is or is not perpendicular to the second axis of rotation of the inner ring relative to the outer ring.

BRIEF DESCRIPTION OF THE DRAWINGS

The invention will be better understood upon reading the following description of different embodiments, provided as an example and done in reference to the drawings, in which.

DETAILED DESCRIPTION OF THE INVENTION

Figure 1:
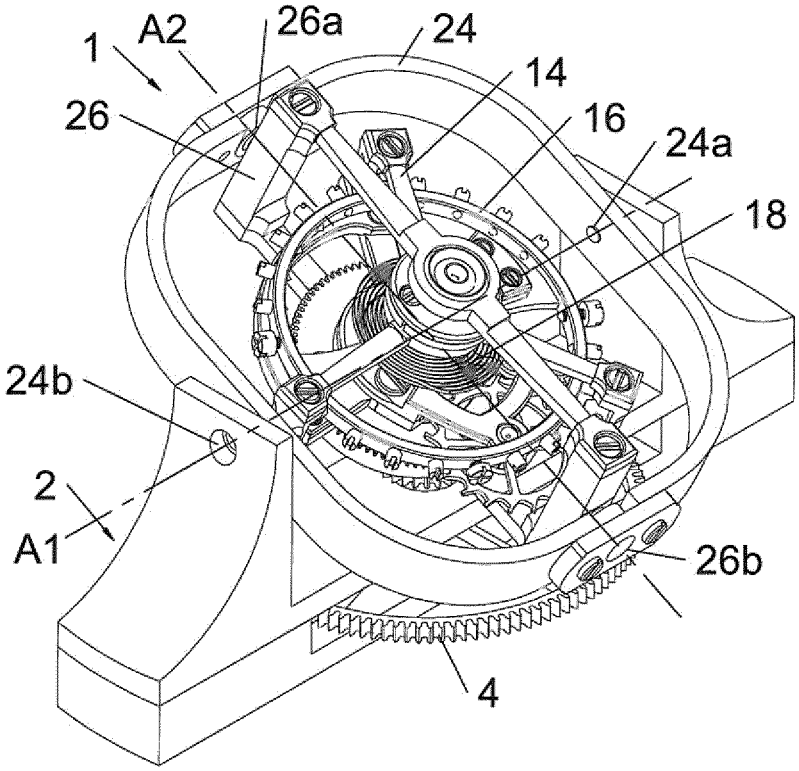
FIGS. 1 and 2 show perspective views of the tourbillon mechanism according to the invention, the outer ring respectively being in each of its maximal positions relative to its axis of rotation.
Figure 2:
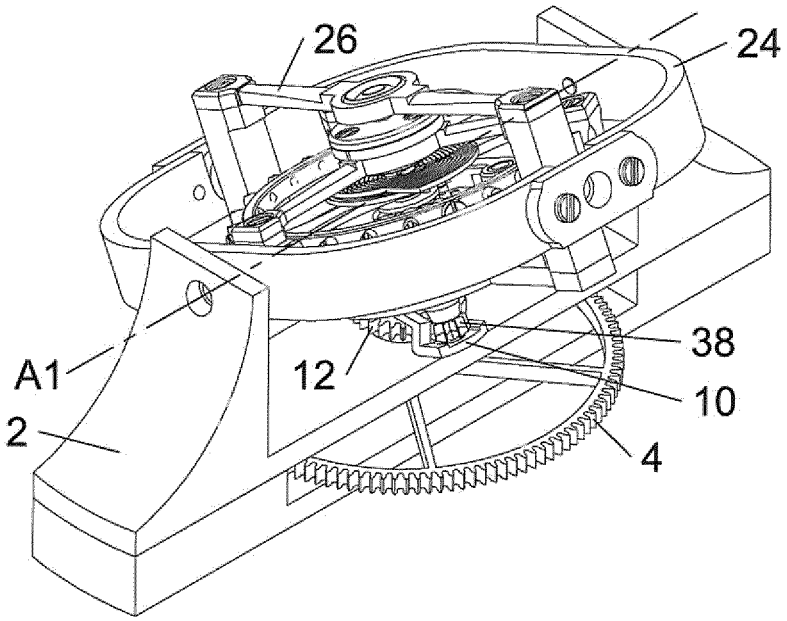
Figure 6:
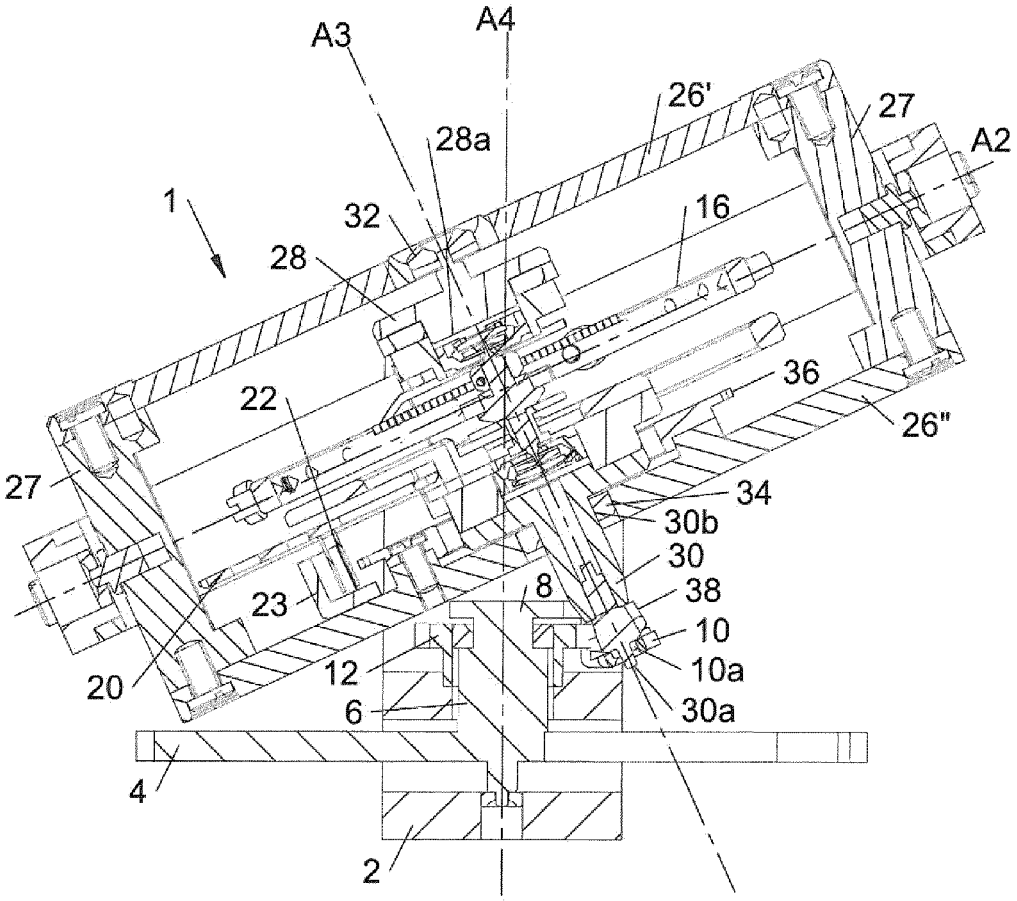
FIG. 6 is a cross-sectional view of the tourbillon mechanism according to the invention.

In reference to FIGS. 1, 2 and 6, an alternative embodiment is shown of a tourbillon mechanism 1 according to the invention mounted on a frame 2 of a timepiece. Generally, the frame is an assembly formed by a bar and a plate, but of course the frame can comprise any support element for the organs of the timepiece.

On the frame 2, a wheel 4 of a going train is pivotably mounted, such as the mean disc. The wheel 4 comprises an arbor 6 on which a driving element 8 is securely mounted, bent and ending with a bracket 10, the role of which will be described hereafter.

Also mounted securely on the frame 2 is a first stationary disc 12, around the arbor 6 of the wheel 4.

The tourbillon mechanism comprises a tourbillon carriage 14 bearing a balance 16, a balance-spring 18 and an escapement, traditionally comprising an escapement disc 20 and an escapement pinion 22 pivotably mounted in a support organ 23 secured to the tourbillon carriage 14. The other elements of the tourbillon carriage 14, such as the pallet, are known by those skilled in the art and will not be described in more detail here. Of course, the invention also applies to a karussel mechanism, the tourbillon carriage then being replaced by a support bearing the balance and the escapement, and the disc 12 not being stationary, as described in patent CH 7965.

Furthermore, in the illustrated alternative, the pallet and the escapement disc are loaded on the tourbillon carriage 14. It is also possible for only the pallet to be loaded on the carriage, the escapement disc then being mounted stationary, as described in patent EP 2,132,604.

According to the invention, the tourbillon mechanism further comprises:

an outer ring 24 rotatably mounted on the frame around a first axis A1, using two pivots 24*a*, 24*b*, an inner ring 26 mounted inside the outer ring 24 and rotatable relative to the outer ring 24 around a second axis A2 perpendicular to the first axis A1, using two pivots 26*a*, 26*b*.

In the present description, the term "ring" designates an element that surrounds another element, but does not necessarily have an annular shape. Thus, in the illustrated example, the outer ring 24 has an annular shape, while the inner ring 26 has a rectangular shape, comprising an upper part 26' and a lower part 26", connected by two side pillars 27. Of course, the rings used in the invention may assume any other appropriate shape.

The frame 2 has a recess, the shape of which is suitable for allowing pivoting of the tourbillon mechanism.

Furthermore, the tourbillon carriage 14 comprises, secured to said tourbillon carriage 14, an upper arbor 28 provided with a pivot 28*a* and a lower arbor 30 provided with a swivel 30*b*. The pivot 28*a* and the swivel 30*b* are respectively engaged in bearings 32, 34 of the inner ring 26, such that the tourbillon carriage 14 is pivotably mounted in said inner ring 26. The dimensions of the inner ring 26 are chosen such that the tourbillon carriage 14 can be housed therein and rotate freely therein.

Furthermore, a second disc 36 is securely mounted on the inner ring 26, coaxially to the arbor of the tourbillon carriage 14.

The escapement pinion 22 is positioned such that it meshes with the second wheel 36, secured to the inner ring 26.

Figure 5:
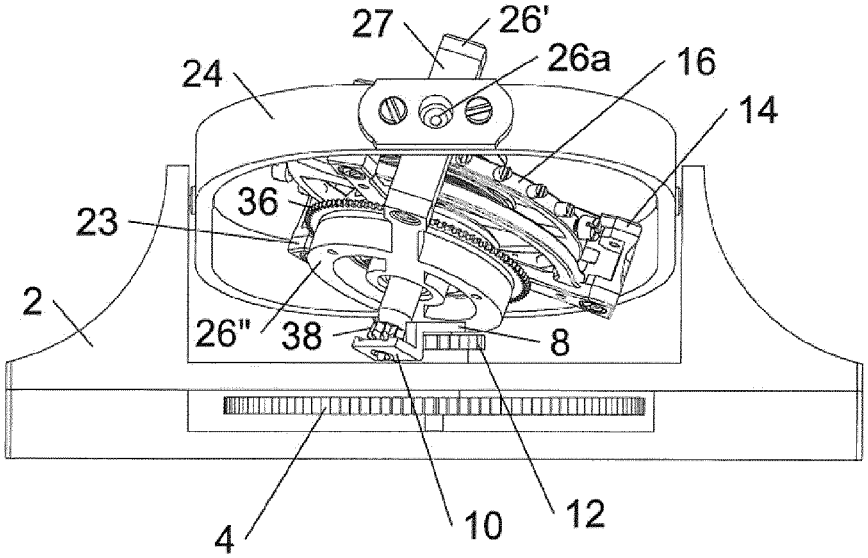
FIG. 5 shows a perspective view of the tourbillon mechanism of the invention, the outer ring and the inner ring being in intermediate positions.

The lower arbor 30 is mounted passing through the lower part 26" of the inner ring 26, such that said inner ring 26 is mounted freely rotating around the lower arbor 30 along a third axis of rotation A3. More particularly, the lower part 26" of the inner ring 26 comprises an annular base concentrically positioned around the lower arbor 30 and bearing the second wheel 36, as shown in FIG. 5.

The lower arbor 30 includes, at its free end, a first pinion 38 having a conical tubing and positioned such that it meshes with the first stationary disc 12, secured to the frame. In the illustrated alternative, the stationary disc 12 is a toothed organ having an outer toothing. It is clear that the stationary disc may be replaced by a crown having an inner toothing.

The lower arbor 30 has, at its free end, a pivot 30*a* engaged in a bearing 10*a* provided on the bracket 10 of the driving element 8. Thus, the driving element 8 secured to the arbor 6 of the wheel 4 constitutes the means for driving the lower arbor 30 in which said lower arbor 30 is guided while forming a connection of the ball joint type. These means for driving the lower arbor 30 indirectly constitute the means for driving the inner ring 26, as will be seen hereafter.

Figure 7:
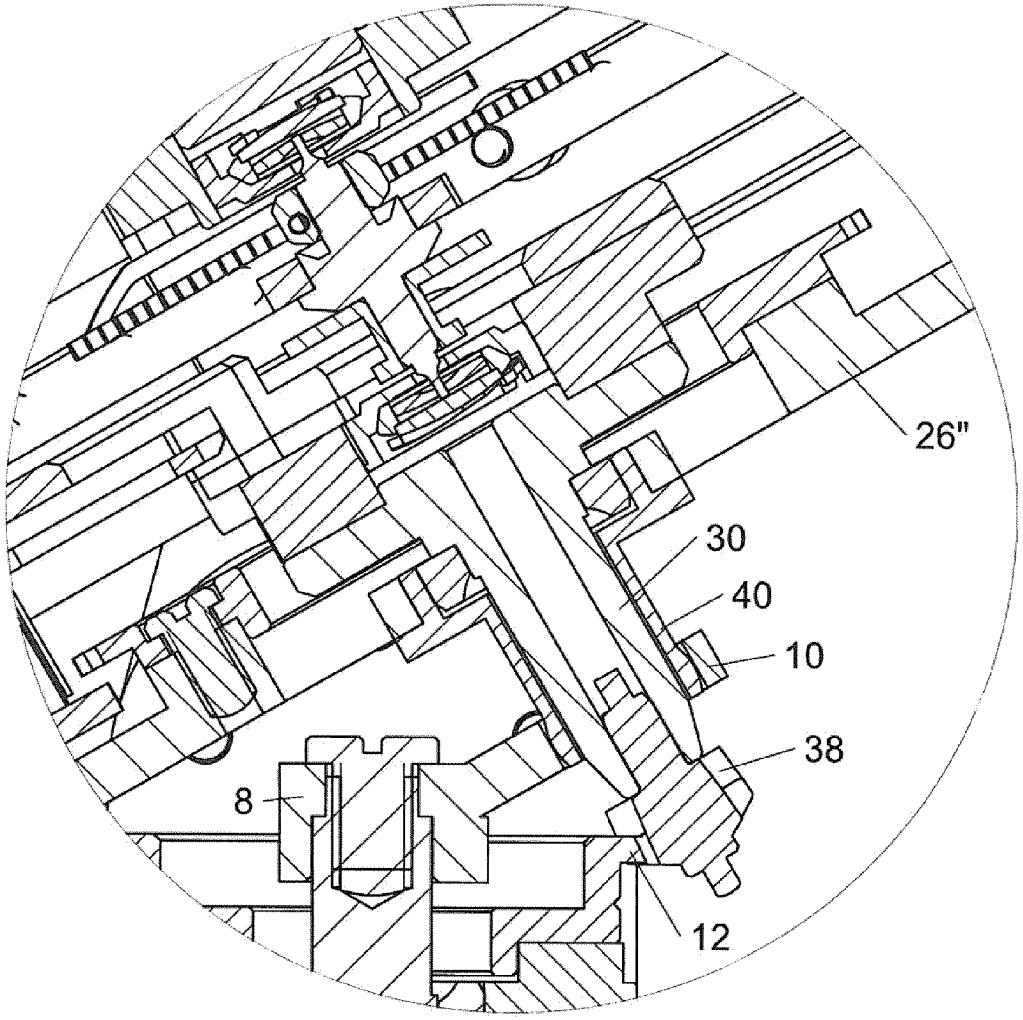
FIG. 7 is a cross-sectional view of a detail of another alternative embodiment of the tourbillon mechanism according to the invention.

In another alternative embodiment shown in FIG. 7, the inner ring 26 cooperates directly with the driving element 8. To that end, the inner ring 26 includes a tube 40, secured to its lower part 26", coaxial to the lower arbor 30 of the tourbillon carriage 14. The tube 40 is positioned around said lower arbor 30 such that the latter can rotate freely in the tube 40. As in the first alternative, the lower arbor 30 includes a first pinion 38 meshing with the stationary disc 12. In this alternative, it is the tube 40 of the inner ring 26 that operates directly with the bracket 10 of the driving element 8. Thus, the driving element 8 secured to the arbor 6 of the wheel 4 constitutes the means for driving the inner ring 26 in which the tube 40 is guided while forming a connection of the ball joint type.

Of course, the inner ring 26 may also be driven by its upper part, the driving element, the wheel of the going train, the arbor of the tourbillon carriage and the tube of the inner ring being provided on the side of its upper part 26'.

The inner ring 26 is positioned such that the lower arbor 30 of the tourbillon carriage 14 forms a non-zero angle with the first stationary disc 12, preferably comprised between 5° and 85°.

In the illustrated alternative, the axis A4 of the first stationary disc 12 is perpendicular to the frame 2. The axis A4 is combined with the axis of rotation of the wheel 4.

Of course, the axis of rotation of the wheel of the going train may not be perpendicular to the frame, the tourbillon mechanism then being positioned accordingly.

In the illustrated alternative, the tourbillon carriage 14 is positioned such that its axis of rotation is perpendicular to the second axis of rotation A2 of the inner ring 26 relative to the outer ring 24.

The third axis of rotation A3 of the inner ring 26 around the lower arbor 30 of the tourbillon carriage 14 is preferably perpendicular to the second axis of rotation A2 of the inner ring 26 relative to the outer ring 24, which means that the axis of rotation of the tourbillon carriage 14 is combined with the third axis of rotation A3 of the inner ring 26 around the lower arbor 30.

In the illustrated alternative, the balance axis is positioned coaxially to the axis of rotation A3. Of course, in other alternative embodiments that are not shown, the balance axis may be parallel to the axis of rotation A3 or inclined such that it is not combined with the axis of rotation A3 of the inner ring around the lower arbor of the tourbillon carriage. The pallet and the escapement wheel will be positioned accordingly.

The tourbillon carriage and the upper and lower parts of the inner ring can then be arranged suitably, as for example described in patent EP 1,419,419.

When the movement operates, the wheel 4 of the going train is animated by a rotational movement so as to subject the inner ring 26 to a motor torque by meshing with the first pinion 38. In fact, when the wheel 4 is rotating, its arbor 6 is also able to pivot and rotate the driving element 8 with it. According to the first alternative, the lower arbor 30 guided in the bracket 10 of the driving element 8 is then able to rotate around the axis A4. According to the second alternative, it is the tube 40 guided in the bracket 10 of the driving element 8 which is then able to rotate around the axis A4, driving the rotational movement of the lower arbor 30 around the axis A4. During this movement, the first pinion 38 secured to the lower arbor 30 can mesh with the first stationary disc 12 such that the inner arbor 30 is also able to pivot around the axis A3 to rotate the tourbillon carriage 14.

However, the motor torque can only create a movement of the lower arbor 30 and therefore the inner ring 26 if the first pinion 38 meshes with the first stationary disc 12, and therefore if the tourbillon carriage 14 rotates around the axis A3. Since the escapement pinion 22 is engaged with the toothing of the second wheel 36, that means that this movement is only possible when the escapement imparts a driving impulse to the balance.

In the first alternative, when the lower arbor 30 moves, the latter being mounted inclined passing in the lower part 26" of the inner ring 26, said inner ring 26 must also move while remaining inclined, consequently driving the outer ring 24, thereby imparting a composite movement to the tourbillon carriage 14. In the second alternative, the inner ring 26 is directly driven by the driving element 8. Due to this composite movement, the pivots 26*a*, 26*b* of the inner ring 26 perform an alternating rotational movement perpendicular to the axis A1 of the outer ring 24. The inner ring 26 tilts around its pivots 26*a*, 26*b* while being driven by the outer ring 24 and by the lower arbor 30 or directly by the driving element 8.

At the same time, the lower arbor 30 is rotated around the axis A3 by its pinion 38 meshing with the first stationary disc 12. The rotation of the lower arbor 30 drives the rotation of the tourbillon carriage 14 and therefore of the escapement pinion 22. The latter meshes with the second disc 36 to drive the rotation of the escapement disc 20, the latter cooperating with a pallet to maintain the movement of the balance 16.

FIGS. 1 and 2 show views in which the outer ring 24 respectively occupies a maximal position relative to its axis of rotation A1.

Figure 3:
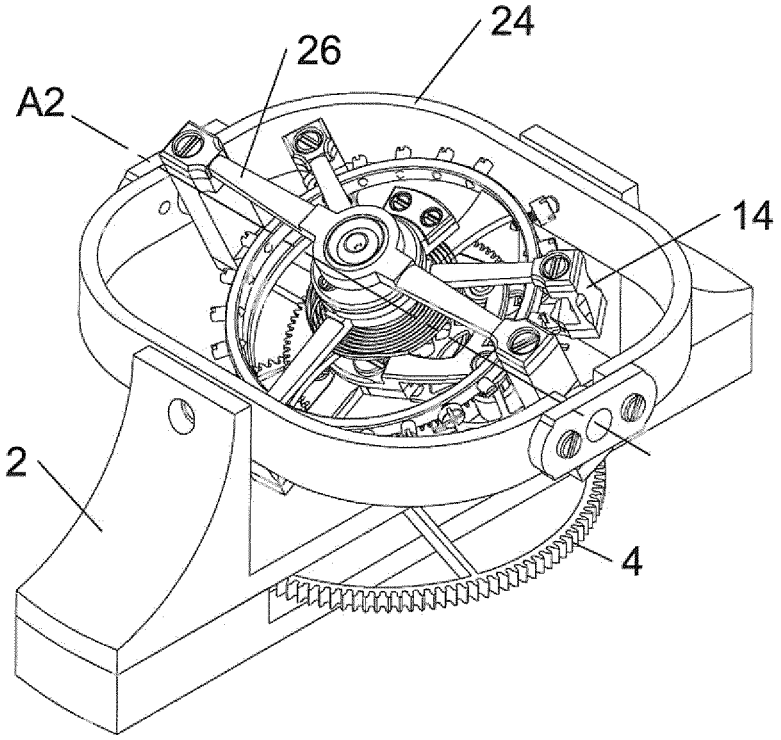
FIGS. 3 and 4 show perspective views of the tourbillon mechanism according to the invention, the inner ring respectively being in each of its maximal positions relative to its axis of rotation.
Figure 4:
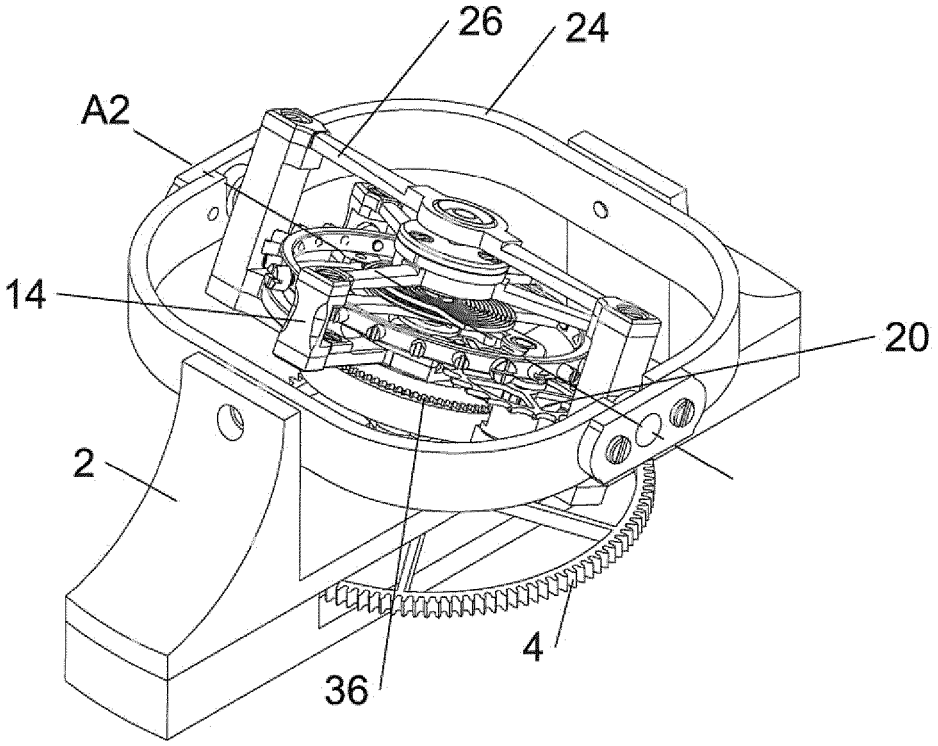

Other positions of the tourbillon mechanism are shown in FIGS. 3 to 5, the same elements being shown with the same references.

FIGS. 3 and 4 show the tourbillon mechanism in which the inner ring 26 respectively occupies its maximal position relative to its axis of rotation A2, and FIG. 5 shows the tourbillon mechanism in which the outer ring 24 and the inner ring 26 occupy intermediate positions relative to those shown in the figures.

In the illustrated alternative, the movement of the axis of rotation A3 of the inner ring 26 relative to the axis A4 generates at least one frustoconical enclosure.

The composite movement obtained by the tourbillon mechanism according to the invention makes it possible to decrease the time spent by the balance in unfavorable positions. Furthermore, using two rings makes it possible to decrease the inertia relative to a traditional tourbillon carriage.

Additionally, the tourbillon mechanism according to the invention is such that it comprises at least 4 pivot points instead of 2 in a traditional tourbillon, such that the impact resistance of the tourbillon mechanism according to the invention is increased.

Of course, the present invention is not limited to the described embodiment. In particular, the shape of the rings may vary. It is also possible to provide other inner rings arranged relative to one another such that none of them are floating. It is also possible to provide a fly carriage in which the pivoting of the inner ring only occurs on the side of the carriage that is rotated.

The invention claimed is:

1. A timepiece, comprising:

a frame;

at least one wheel of a moving train; and at least one tourbillon mechanism comprising a support bearing a balance, at least one element of an escapement, an outer ring rotatably mounted on the frame around a first axis, at least one inner ring mounted inside the outer ring and rotatable relative to the outer ring around a second axis, the support being pivotably mounted in the inner ring and being secured to an arbor around which the inner ring is mounted, freely rotating along a third axis, a first toothed organ, mounted on the frame, a first pinion secured to the arbor of the support arranged to cooperate with said first toothed organ so as to rotate said support, and means for driving the inner ring cooperating with a wheel of the moving train and arranged to move the inner ring and the outer ring thereby providing the support a composite movement.

2. The timepiece according to claim 1, wherein the means for driving the inner ring comprise a driving element secured to an arbor of the disc of the going train.

3. The timepiece according to claim 2, wherein the driving element cooperates with the arbor of the support so as to impose a rotating movement thereon around the first toothed organ.

4. The timepiece according to claim 2, wherein the inner ring comprises a tube that is secured thereto, wherein the arbor of the support can rotate freely, and wherein the driving element cooperates with said tube so as to impose a rotational movement around the first toothed organ on the inner ring.

5. The timepiece according to claim 1, wherein the arbor of the support is angled with respect to the first toothed organ.

6. The timepiece according to claim 1, wherein the tourbillon mechanism further comprises a second toothed organ secured to the inner ring and arranged to cooperate with a second pinion kinematically connected to the escapement.

7. The timepiece according to claim 1, wherein the support is positioned such that an axis of rotation of the support is perpendicular to the second axis of rotation of the inner ring relative to the outer ring.

8. The timepiece according to claim 1, wherein the support is positioned such that an axis of rotation of the support is not perpendicular to the second axis of rotation of the inner ring relative to the outer ring.

* * * * *